United States Patent [19]

Rammos

[11] Patent Number: 4,641,145

[45] Date of Patent: Feb. 3, 1987

[54] MICROWAVE ANTENNA HAVING AN ARRAY OF RADIATING ELEMENTS FOR CIRCULARLY POLARIZED SIGNALS

[75] Inventor: Emmanuel Rammos, Creteil, France

[73] Assignee: U.S. Philips Corporation, New York, N.Y.

[21] Appl. No.: 767,684

[22] Filed: Aug. 19, 1985

Related U.S. Application Data

[63] Continuation of Ser. No. 421,937, Sep. 23, 1982.

[30] Foreign Application Priority Data

Sep. 23, 1981 [FR] France ..... 81 17915

[51] Int. Cl.[4] ..... H01Q 1/38; H01Q 21/26

[52] U.S. Cl. ..... 343/798; 343/768; 343/816

[58] Field of Search ..... 343/700 MS, 768, 798, 343/816, 830, 846, 797

[56] References Cited

U.S. PATENT DOCUMENTS 3,887,925 6/1975 Ranghelli et al. ..... 343/814

FOREIGN PATENT DOCUMENTS 902125 7/1962 United Kingdom .

*Primary Examiner*—Eli Lieberman

*Attorney, Agent, or Firm*—Robert J. Kraus

[57] ABSTRACT

A flat microwave antenna comprising a network of emitting or receiving elements constructed by means of the printed circuit technique on a dielectric support. The elements are arranged on a series of radii (A to H) and are relatively equidistant on each of these radii. In the simplest construction, the radii are equiangularly spaced and the number of elements per radius is equal to $2^n$, n being a positive integer proportional to the length of each radial segment.

3 Claims, 4 Drawing Figures

MICROWAVE ANTENNA HAVING AN ARRAY OF RADIATING ELEMENTS FOR CIRCULARLY POLARIZED SIGNALS

This is a continuation of application Ser. No. 421,937, filed Sept. 23, 1982, now abandoned.

BACKGROUND OF THE INVENTION

The present invention relates to a novel type of microwave antenna comprising an array of receiving elements each including a flat printed circuit structure on a dielectric support. It goes without saying that, due to the reciprocal character of an antenna, a receiving element or an antenna composed of a network of receiving elements is capable of operating as either an emitter (transmitter) or a receiver without modification of its characteristics. This remark remains valid without exception throughout the following description and the term "reception" can be always replaced by the term "emission" without departing from the scope of the invention.

In a large number of applications, and especially in the case of reception of television signals originating from satellites, it is important that the emission diagrams of the microwave antenna used correspond to the recommendations given by the C.C.I.R. (Comiteé Consultatif International des Radiocommunications), which especially relate to the 3 dB-aperture and to the level of the side lobes. This correspondence can be obtained either by spacing adjacent receiving elements at distances which are smaller in the central zone of the antenna than in its peripheral zone, or by spacing all adjacent receiving elements at the same distance from each other while effecting a non-uniform amplitude distribution. However, the networks of non-equidistant sources have the disadvantage that it is a complex operation to position the supply networks because of the somewhat aleatoric arrangement adopted for the sources. When the number of non-equidistant receiving elements is large (which is absolutely necessary to ensure that the antenna has a sufficient gain), it becomes very difficult to position the supply network or networks, especially when parallel supply networks are used, which is due to the high density of the transmission lines of these networks and to the small space available for their placement.

The manufacture of such a very high frequency antenna is complex and expensive, especially in the case where it must receive television signals at 12 GHz with counterclockwise and clockwise rotational polarizations, because receiving elements must be coupled to two distinct supply networks.

SUMMARY OF THE INVENTION

It is an object of the invention to provide a novel structure of a flat very high frequency antenna which simplifies the placement of the supply network or networks while conforming to the aforementioned recommendations.

In accordance with the invention, a microwave antenna comprises a flat printed circuit structure on a dielectric support. The antenna includes a circular array of elements for emitting or receiving microwave signals with clockwise or counterclockwise rotational polarization. All elements have the same structure and are coupled in the same manner to two distinct parallel supply networks including feedline branches arranged in successive stages such that the electrical paths of the signals emitted or received by the elements have identical lengths from each element to a single output terminal for each of the supply networks. Because of the positioning of these elements on a series of substantially radial lines, the density of the elements decreases with distance from the center of the antenna to its periphery and distinct supply networks can be positioned which conversely have a feedline density which increases with distance from the center of the antenna to its periphery. The substantially radial lines have different lengths so that it is possible to position shorter radial lines between longer radial lines, covering the whole surface of the antenna with the elements and the associated feedlines of the supply networks.

The proposed structure is advantageous in a double sense. On the one hand, because the density of elements regularly decreases from the center of the antenna to its periphery the desired 3 dB-aperture and a low level of the side lobes can be adjusted in a simple manner by modification of the angle between two successive radial lines and of the distance between two successive elements on the same radial line. On the other hand, this decrease in density of elements with distance from the centre of the antenna leaves increasingly more space for positioning the supply networks and their successive stages, these networks having an increasing density of feedline branches from the centre of the antenna to its periphery.

BRIEF DESCRIPTION OF THE DRAWING

The particularities and advantages of the invention will appear more precisely from the following exemplary drawing figures.

DESCRIPTION OF THE PREFERRED EMBODIMENT

Figure 1:
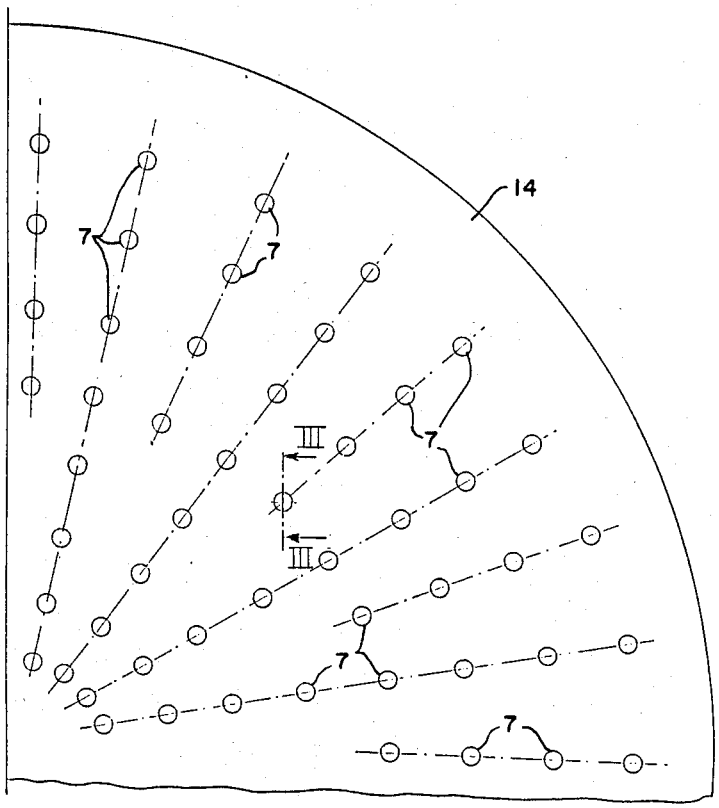
FIG. 1 is a top view of a 90° sector of a circular array antenna according to the invention.
Figure 2:
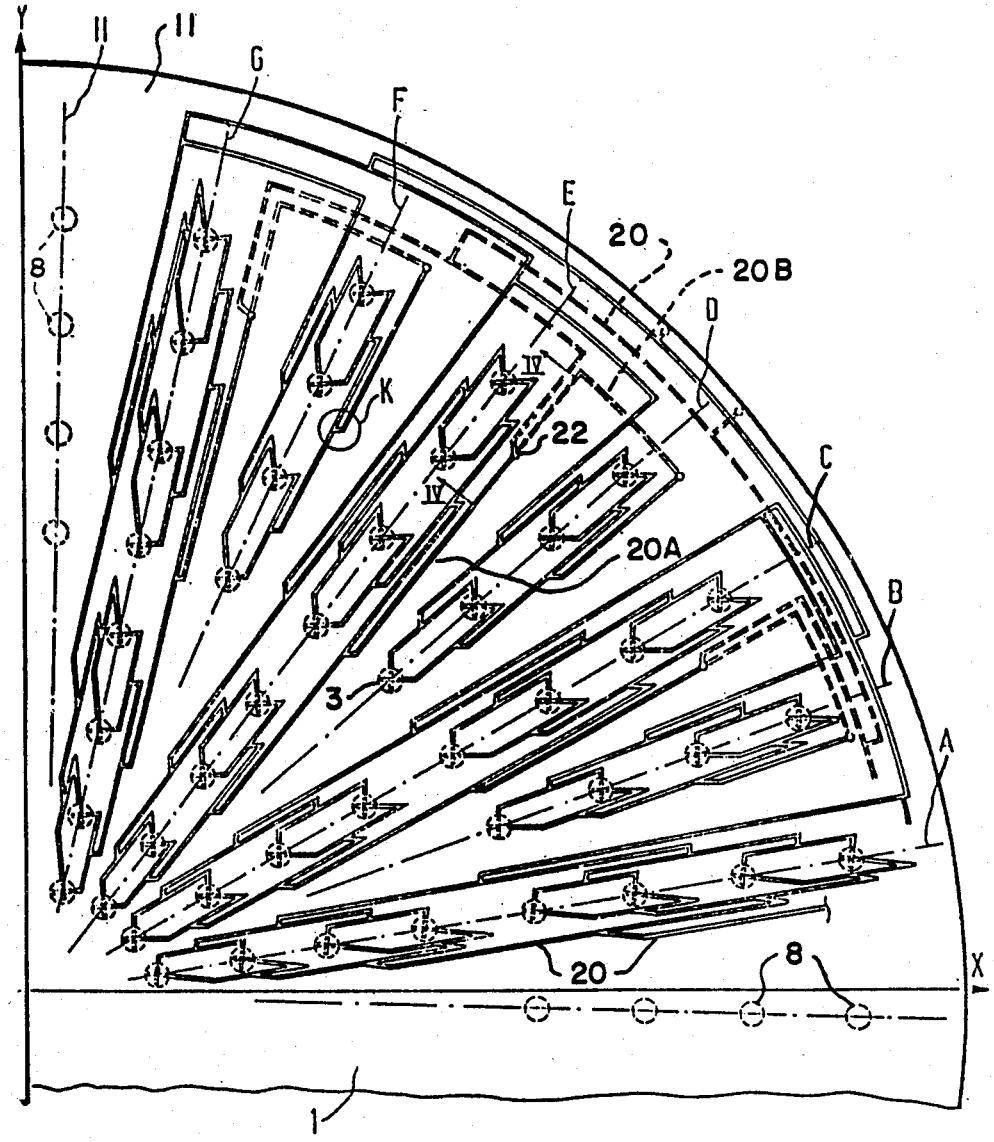
FIG. 2 is another top view of the antenna sector shown in FIG. 1, but shows the antenna with outer conductive and dielectric layers removed to expose underlying feedlines and dipole elements.
Figure 3:
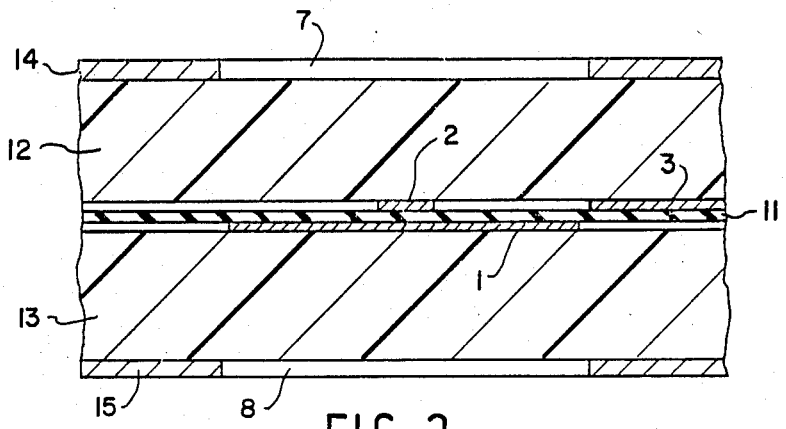
FIG. 3 is a cross section along line III—III of FIG. 1.

The microwave antenna shown in part in FIGS. 1 and 2 is particularly suited for receiving very high frequency signals which may arbitrarily have counterclockwise or clockwise rotational polarizations. The individual receiving elements of the antenna are identical and may be of arbitrary type, but in particular use will be made of one of the structures of receiving elements described in the French Patent Application No. 8108780 filed on May 4th, 1981 by the applicant corresponding to U.S. Pat. No. 4,486,758. As shown in FIG. 3, such receiving elements each have a flat printed circuit structure forming two dipoles 1, 2 insulated from one another by a thin insulating sheet 11 and disposed at right angles to one another in the shape of a symmetrical cross.

Dipole 1 is capacitively-coupled to a feedline 3 having an end aligned therewith but on the opposite side of the insulating sheet 11. Similarly, dipole 2 is capacitively-coupled to another feedline (not shown) which is also aligned therewith but on the opposite side of the sheet 11. The insulating sheet, dipoles, and feedlines are sandwiched between two dielectric planar layers 12 and 13, having on their outer surfaces electrically-conducting layers 14 and 15, respectively, forming ground planes. Circular cavities 7, 8 are provided in the surfaces 14, 15, respectively. Each of the cavities has a diameter which is larger than the lengths of the underlying dipoles, and is located opposite the dipoles such that the dipoles are wholly contained in a cylindrical contour defined by the cavities.

In the preferred embodiment, individual receiving elements are arranged on a series of equi-angularly spaced radii A to H. The elements on each of these radii are equidistant and are disposed on a series of concentric circles. The density of the receiving elements is high at the center of the antenna, decreases towards its outer edge, effecting a radiation power which decreases with distance from the center of the antenna. Directivity can be modified by changing the angles between successive radii and to a smaller extent by changing the minimum and maximum distances between elements on each radius. As a consequence of this structure, the successive radial lines, A, B, C, D, etc., do not necessarily have uniform distributions of receiving elements. In fact, a distinction should be made between main radii, on which the elements are distributed from the central zone of the antenna to its periphery, and secondary radii, which carry fewer receiving elements enabling these radii to be interposed between adjacent main radii where the distance between them is sufficient to permit positioning of receiving elements and associated parts of supply networks.

Figure 4:
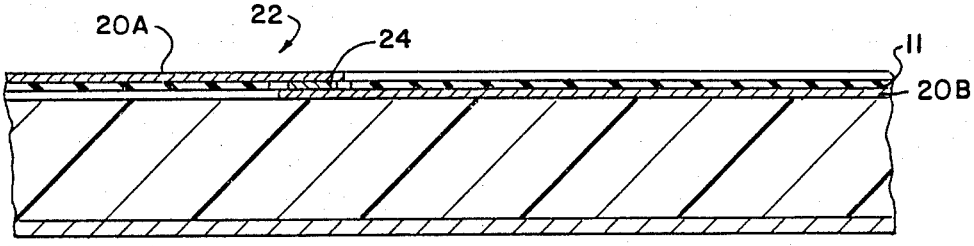
FIG. 4 is a cross section along line IV—IV of FIG. 2.

Referring to FIG. 2, which shows the antenna sector of FIG. 1 with the conductive layer 14 and the dielectric layer 12 removed, the supply networks for the elements include successive stages of microwave feedlines 20 coupled to the receiving elements in the so-called parallel supply structure. First stages of feedline branches couple the elements pairwise, this coupling being identical for all the elements, (which are present here in an even number on each radius, this number being preferably equal to $N=2^n$, where n is a positive integer proportional to the length of the respective radius. Second stages of branches couple pairs of the first stages etc., on the one hand for the first series of dipoles which are parallel to each other and on the other hand for the second series of dipoles at right angles to the first (a network being provided for each series). The final coupling of the stages can be effected at the periphery of the antenna on two different planes for each of the two respective supply networks for signals with counterclockwise and clockwise rotational polarizations. These two different planes of coupling feedlines are on opposite sides of the insulating sheet 11. The feedlines on top of the sheet are shown in FIG. 2 by solid lines, and those underneath the sheet 11 are shown by broken lines. A detailed illustration of an electrical connection 22 formed through an opening in the sheet is shown in FIG. 4, where a feedline 20A on top of the sheet 11 is electrically-connected to a feedline 20B underneath the sheet 11 by a conductive connection 24 disposed in a through hole of the sheet. With this network structure, the electrical paths of the signals are of identical lengths from each receiving element to the respective output terminal of the antenna.

Of course, the invention is not limited to this embodiment, of which modifications can be proposed without departing from the scope of the invention. For the sake of clarity of the Figure, only a limited number of radii and on each radius a limited number of receiving elements are shown. However, it stands to reason that these radii and these elements are actually present in greater numbers and that positioning of elements along the main and secondary radii will be repeated as is permitted by the space available in accordance with the particular geometric arrangement. Another exemplary geometric arrangement is shown in French Patent Application No. 78 26 412 filed by the applicant on Sept. 14th, 1978 (reference is made to FIG. 1 of this application).

What is claimed is:

1. A flat microwave antenna comprising:

(a) a circular array of printed circuit elements each including first and second orthogonal dipoles separated by a dielectric, linear arrangements of said elements being positioned along respective radial lines of the antenna such that shorter arrangements are interposed between longer arrangements as the radial lines diverge sufficiently to provide adequate space for the shorter arrangements, and such that the density of elements in any sector of the circular array decreases with distance from a center of the array; and (b) first and second printed circuit feedline networks electrically-connecting first and second supply terminals to the first and second dipoles of the elements, respectively, each of said networks extending inwardly from the array periphery between the elements and continuously branching out until one branch is provided for each element, the path length from any dipole along the connecting feedline network to the supply terminal for said dipole being substantially equal to that from any other dipole to its respective supply terminal.

2. An antenna as in claim 1 where the number of elements in each linear arrangement is equal to $2^n$, where n is a positive integer proportional to the length of the respective linear arrangement.

3. An antenna as in claim 1 where the elements are arranged on concentric circles.

* * * * *